US005094302A

United States Patent [19]

Back

[11] Patent Number: 5,094,302

[45] Date of Patent: Mar. 10, 1992

[54] DRILLING RIG

[75] Inventor: Carl F. Back, Fort Myers, Fla.

[73] Assignee: Laibe Supply Corporation, Indianapolis, Ind.

[21] Appl. No.: 539,355

[22] Filed: Jun. 15, 1990

[51] Int. Cl.[5] ..... E21B 7/02

[52] U.S. Cl. ..... 173/28; 173/148

[58] Field of Search ..... 173/28, 147, 148, 150, 173/141

[56] References Cited

U.S. PATENT DOCUMENTS

| | | | |
|---|---|---|---|
| 478,795 | 7/1892 | Hummel . | |
| 1,243,580 | 10/1917 | Besancon . | |
| 1,497,310 | 1/1924 | Monroe . | |
| 1,502,383 | 7/1924 | Guerrini et al. . | |
| 2,130,982 | 9/1938 | Gartin | 173/147 X |
| 2,225,588 | 12/1940 | Gartin | 173/147 X |
| 2,410,959 | 11/1946 | Brown | 173/148 X |
| 2,903,949 | 9/1959 | Simmonds | 173/28 X |
| 3,464,655 | 9/1969 | Schuman | 173/148 X |
| 3,520,374 | 7/1970 | Ebert | 173/147 X |
| 3,732,935 | 5/1973 | Gibson | 173/147 X |
| 3,867,989 | 2/1975 | Hisey et al. . | |
| 4,049,064 | 9/1977 | Chubb et al. | 173/147 |
| 4,646,206 | 2/1987 | Bauer et al. . | |

*Primary Examiner*—Douglas D. Watts
*Assistant Examiner*—Rinaldi Rada
*Attorney, Agent, or Firm*—Woodard, Emhardt, Naughton Moriarty & McNett

[57] ABSTRACT

A mobile drilling rig includes a rectangular tube which is used for the derrick and is normally transported on the vehicle in a generally horizontal attitude. The derrick is pivoted to vertical position by a hydraulic cylinder. A pulldown system located inside the tube includes a double-acting hydraulic pulldown cylinder, drive pinions mounted to the piston rod, one gear rack fixed inside the tube and another gear rack slidable inside the tube. A drill-driving powerhead is slidably mounted on the outside of the tube and is connected to the slidable gear rack. The pinions connected to the pulldown cylinder piston rod engage both racks and, with a piston stroke less than half the length of the tube, drive the power head essentially the full length of the tube for the pull-down function.

12 Claims, 3 Drawing Sheets

DRILLING RIG

BACKGROUND OF THE INVENTION

1. Field of the Invention

This invention relates generally to vehicle-mounted drilling rigs for wells and the like, and more particularly to the derrick or mast for a relatively light-weight, truck-mounted rig.

2. Description of the Prior Art

Truck-mounted drilling rigs are well known and widely used They range in size and capacity from a relatively small and light-weight, truck-mounted unit as shown in U.S. Pat. No. 2,410,959 to a relatively large and heavy unit mounted on a track-laying vehicle as shown in U.S. Pat. No. 3,867,989. In many cases, the drilling rig includes a multi-section derrick similar in appearance to that shown in U.S. Pat. No. 3,867,989, which is an assembly of several lengths of structure which are normally transported on the truck in a horizontal attitude, but then assembled end to-end at the drilling site and raised to a vertical attitude for the drilling operation. These derricks include winches, cables and sheaves to raise and lower the drilling bit and attached string of pipe, and to force the drill into the ground, using the weight of the derrick and the rear end of the transporting truck to apply the downward load onto the drill bit. These structures are rather complicated, heavy, have many working components exposed to the environment, have a generally cluttered appearance and are expensive. It is therefore a general object of the present invention to provide a well drilling rig overcoming some of these disadvantages of the prior art.

SUMMARY OF THE INVENTION

Described briefly, according to a typical embodiment of the present invention, a mobile drilling rig includes a rectangular tube used for the derrick or mast, and normally transported on the vehicle in a generally horizontal attitude. The derrick is pivoted to vertical position at the drilling site by a hydraulic cylinder. The drill driving powerhead is slide-mounted on the tube and coupled to a pulldown system located inside the derrick tube. The pulldown system includes a double-acting hydraulic cylinder, drive pinions mounted to the piston rod, a gear rack fixed inside the tube and another gear rack inside the tube but slidable along its entire length, and secured to the powerhead which is outside the tube. The pinions connected to the pulldown cylinder piston engage both racks and, with a piston stroke less than half the length of the tube, drive the power head essentially the full length of the tube for the pulldown function.

DESCRIPTION OF THE PREFERRED EMBODIMENT

Figure 1:
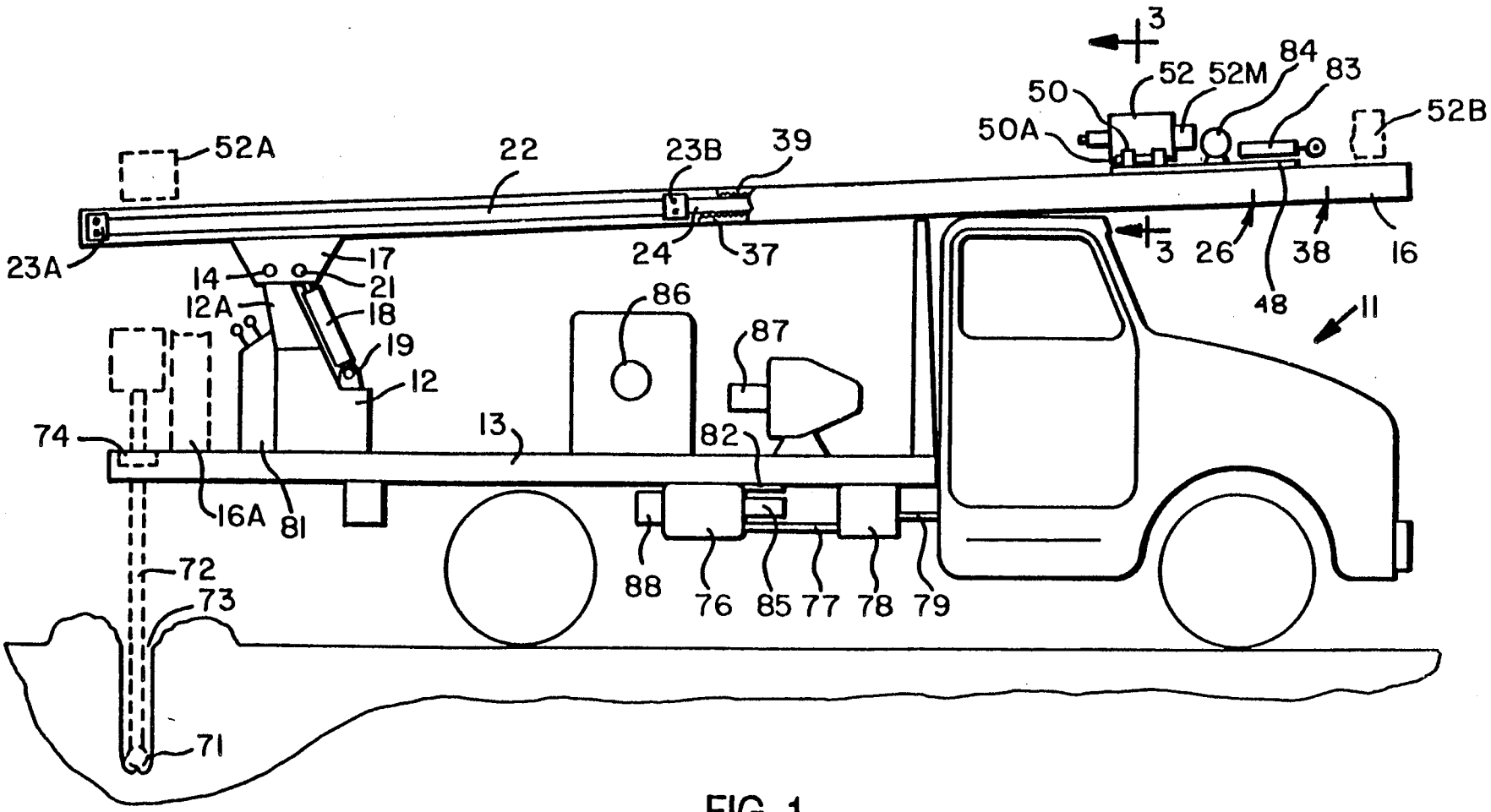
FIG. 1 is a schematic side elevational view of the drilling rig according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, and more particularly FIG. 1, the motor truck 11 has a pedestal 12, the lower part of which is a hydraulic fluid storage tank mounted near the rear end of the truck bed 13 and having a top bracket 12A mounting a hinge pin 14 at the top of the pedestal. A steel tube 16 has a pair of hinge plates 17 mounted to its sides adjacent each of the two bottom corners of it and which form a yoke straddling the pedestal top 12A and pinned to it by the pin 14, whereby the tube can be pivoted about the axis of pin 14 from a generally horizontal transport position as shown in FIG. 1 to the vertical drilling position shown by the dotted outline 16A in FIG. 1. This pivoting action is powered by a double acting, single rod-end hydraulic lifting cylinder 18 pinned to the pedestal at 19 and having piston rod pinned to the hinge plates at 21.

A hydraulic pull-down cylinder 22 is locate in the tube 16. It is a double-acting cylinder having heads at both ends, each of which is bolted to the sides of the tube by a pair of bolts in each side. Cylinder head 23A is bolted adjacent the rear end of the tube 16. The piston rod end head 23B is bolted to the tube near the longitudinal center of the tube. The piston rod end head 23B is bolted to the tube near the longitudinal center of the tube. Cylinder 22 is a double-acting, single rod end cylinder. The piston rod 24 projects through head 23B at the front end and, under hydraulic pressure, can be driven forward to a location 26 near the front end of the tube 16.

Figure 2:
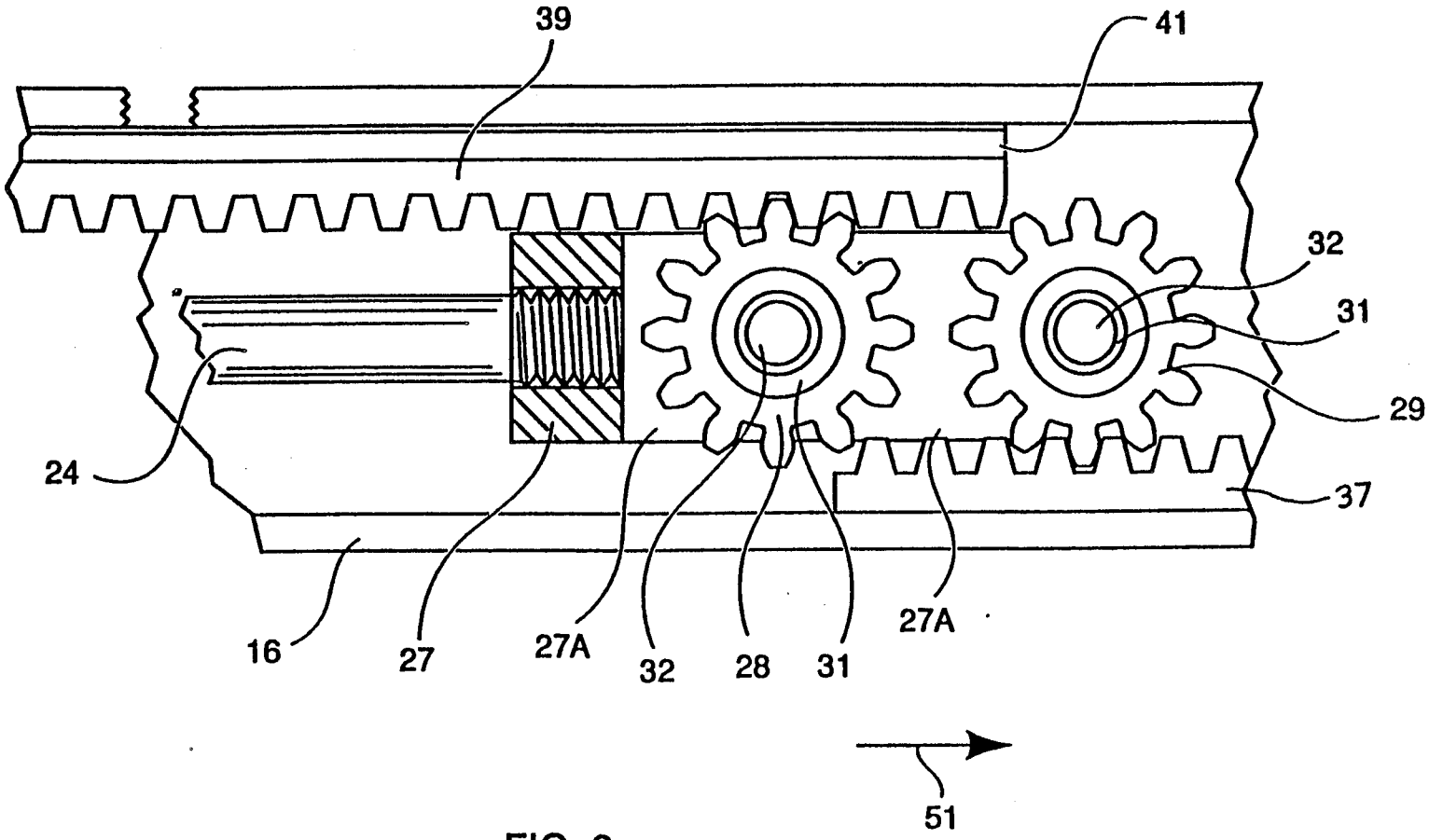
FIG. 2 is an enlarged fragmentary side elevational view of a portion of the derrick and pulldown drive assembly.
Figure 3:
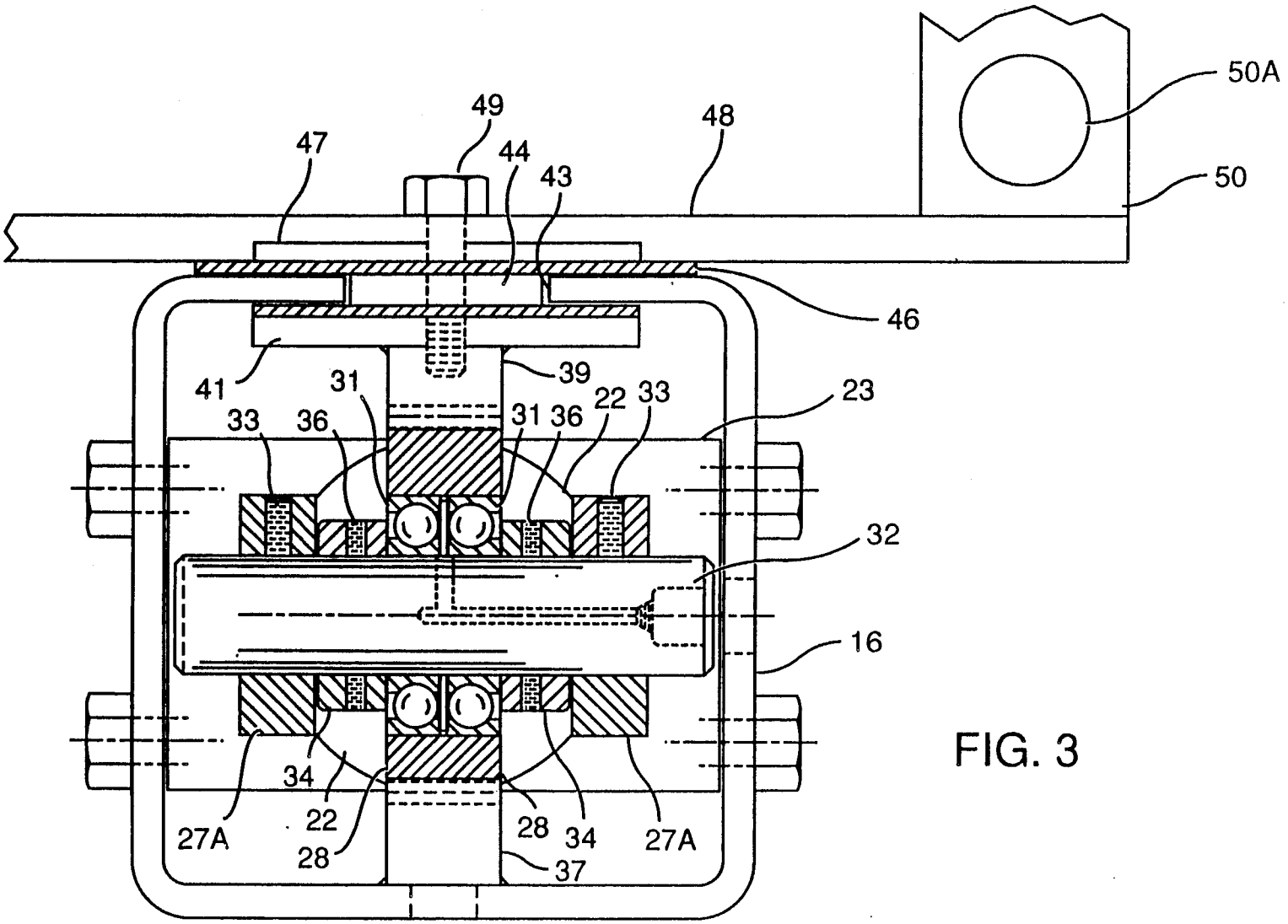
FIG. 3 is a much enlarged cross section through the derrick taken at line 3—3 in FIG. 1 and viewed in the direction of the arrows.

The base 27 of a cylinder rod yoke is screwed onto the distal end of piston rod 24 as shown in FIG. 2. The arms 27A of the yoke (FIGS. 2 and 3) support two drive pinions 28 and 29 which are mounted through ball bearing assemblies 31 to the drive pinion shafts 32 which are received in holes in the cylinder rod yoke arms and secured there by set screws 33. The proper spacing between the yoke arms and the bearing assemblies is provided by collars 34 mounted to each shaft 32 between the bearing assembly 31 and the respective arm of the yoke and secured to the pinion shaft 32 by set screws 36.

A gear rack 37 is welded to the bottom of the tube 16 and extends forward to about point 38 (FIG. 1) near the forward end of the tube 16. A movable gear rack 39 is welded to the bottom of a plate 41 which is slidably mounted in the tube 16. This rack is approximately 13 feet long. Wear strips 42 are mounted on top of rack mounting plate 41 throughout its length. An elongate slot 43 in the top of the tube 16 and extending throughout its length accommodates a combination bearing spacer and guide bar 44 which is mounted on top of the wear strips 42 and on which are mounted wear strips 46. A wear strip retainer plate 47 is mounted on top of the strips 46. A top head mounting plate 48 is bolted to the combination of the rack mounting rail 41, wear strips 42, guide bar 44, a wear strip 46, and plate 47 by bolts 49. Consequently, this assembly is slidable along the tube 16 and guided by the guide bar 44 in the guide slot 43 in the tube 16. Brackets 50 and pins 50A on both sides of top head mounting plate 48 secure the head 52 to plate 48 but, in conventional manner, enable it to be swung out of the way for use of the sand reel and/or the hoist, when desired.

FIG. 2 shows the relationship of the two pinions 28 and 29 and the stationary gear rack 37 and sliding gear rack 41 during installation of the sliding gear rack 39 in direction of arrow 51 into the rear end of the assembly when the derrick assembly is being built at the factory. Pinion 29 first engages the stationary gear rack 37 when the cylinder 22 is installed through the rear end of the tube and with the piston fully retracted. Then, when the sliding gear rack is installed in the tube, it first engages the pinion 28, and can be moved forward on it until engagement with the pinion 29. At this point, the rear end of the rack has entered the tube 16, so that the rack 39 is fully inside the tube. Further advance of the sliding gear rack requires movement of the piston rod 24 in the direction of the arrow 51 (FIG. 2) toward the front of the tube 16.

With this relationship of the racks and pinions, travel of the rack 39 is at a rate twice the lineal rate of advance of the piston rod 24. Consequently, the top head mounting plate 48, and the top head 52 mounted to it can be moved from the dotted line position 52A (FIG. 1) at the rear end to the dotted line position 52B at the front end as the piston rod moves from the retracted position shown in dotted line in FIG. 1 to the fully extended position at point 26 near the front end of the tube.

As indicated above, the pedestal 12 includes a tank for hydraulic fluid. The hydraulic fluid pressure is provided by three pumps, each of which is mounted to a "tri-drive" unit 76. Each of the pumps has an input shaft coupled to a different one of the three power outputs of the unit 76 and mechanically driven by it. The power input to the unit 76 is from the drive shaft 77 output from the transfer case 78 of the truck and which has an input shaft 79 from the vehicle transmission so the unit is driven by the truck engine. A control console 81 is provided at the left rear of the truck bed and includes a number of valves and manual operating levers for them (not specifically shown). Hydraulic fluid is provided to the valves by the three pumps connected to the tri-drive unit. The first is a gear pump 82 which is used to provide hydraulic pressure for the stabilizing jack cylinders (not shown), the derrick lift cylinder 18, both the high speed supply and low speed supply to the pulldown cylinder 22, both hydraulic motors 52M (one shown) in the drill head 52, the hoist cylinder 83 mounted on top of the top head mounting plate 48 and the hydraulic rotary motor for driving the same line reel 84, also mounted to the plate 48.

A second gear pump 85 is also mounted to and has an input from the tri-drive unit 76 and supplies additional hydraulic fluid at pressure to cylinder 22 for the high speed pulldown function. Pump 85 also provides power for a hydraulic fluid radiator cooling fan drive motor 86 and for a drive motor for an air compressor 87 and for other hydraulic units.

The tri-drive unit also provides an output drive to a hydrostatic pump 88 which provides hydraulic power for a centrifugal mud pump and a water injection pump. The latter components are not shown since they do not have any direct applicability to the present invention.

In operation of the equipment, when the truck is driven to the drilling site, the stabilizing jacks are deployed and the other usual steps are taken in preparation for drilling. The derrick is raised to the vertical position shown by dotted line 16A in FIG. 1 at the site where the hole is to be drilled. The power head 52 is driven to the forward (now uppermost position on the derrick), by extending the piston rod 24. The drill rod (pipe) 72 is raised by the hoisting cylinder and cable from a storage rack (not shown) on the side of the truck, and the upper end is connected to the powerhead. A drill bit 71 is at the lower end. The pipe is located in the conventional bearing table 74 at the rear of the truck bed. Then the pulldown cylinder is operated to start the drill into the ground 73 as the drill is rotated by the power head. The pulldown cylinder is operated to pull the top head down as drilling progresses. When it is desired to raise the top head to add another length of pipe, the drill string is separated in the normal manner, additional length of pipe is installed, and the top head is brought down to continue the drilling.

From the foregoing description, it should be recognized that the present invention provides a neat, compact, reliable, mobile drilling rig.

The overall length of the tube 16 may be 27 feet. The pulldown cylinder may be a 3½ inch bore cylinder with 11 foot stroke. The wear strips may be a series 1900 U.H.M.W. polymer 5 inches wide and ⅛ inch thick. A "Teflon" material would be suitable. The tube 16 is typically 8 inches square rolled steel tube with a ⅜ inch wall thickness and 2⅝ inches wide slot cut the full length of the top, as described above. Spacers may be welded across the ends of the tube to stabilize gap width independent of side loading on the tube in operation.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

I claim:

1. In a drilling rig, the combination comprising:

a first carriage;

a tubular member mounted on the carriage for transportation of the tubular member from site to site, said tubular member, being movable relative to the carriage from a generally horizontal attitude to a vertical attitude;

a second carriage, said second carriage being mounted on said tubular member and linearly drivable along said tubular member;

travel-multiplying means inside said tubular member and connected to said second carriage;

actuator means inside said tubular member and having a first portion secured to said tubular member and a second portion linearly movable inside said tubular member and connected to said travel-multiplying means to drive said second carriage longitudinally along said tubular member as said means drives said second portion of said actuator means longitudinally inside said tubular member;

said actuator means include a hydraulic actuator;

said hydraulic actuator includes a hydraulic cylinder, piston and rod assembly;

said cylinder having an end fastened to said tubular member and said piston rod having an end fastened to said travel multiplying means; and said travel multiplying means include a stationary gear rack fastened to said tubular member, a movable gear rack linearly drivable along said tubular member, and a pinion engaging said racks, said pinion being connected to said piston rod end.

2. In a drilling rig, the combination comprising:

a first carriage;

a tubular member mounted on the carriage for transportation of the tubular member from site to site, said tubular member, being movable relative to the carriage from a generally horizontal attitude to a vertical attitude;

a second carriage, said second carriage being mounted on said tubular member and linearly drivable in opposite directions along said tubular member;

travel-multiplying means inside said tubular member and connected to said second carriage; and actuator means inside said tubular member and having a first portion secured to said tubular member and a second portion linearly movable inside said tubular member and connected to said travel-multiplying means to drive said second carriage longitudinally along said tubular member in said opposite directions as said actuator means drives said second portion of said actuator means longitudinally inside said tubular member; and whereby movement of said second portion of said actuator means transmitted to said second carriage via said travel-multiplying means results in said second carriage moving a distance which is a known multiple of the distance moved by said second portion of said actuator means.

3. The combination of claim 2 wherein:

said actuator means include a hydraulic actuator.

4. The combination of claim 3 wherein:

said hydraulic actuator includes a hydraulic cylinder, piston and rod assembly, said cylinder having an end fastened to said tubular member and said piston rod having an end fastened to said travel multiplying means.

5. In a drilling rig, the combination comprising:

a first carriage;

a tube mounted on said carriage for transportation of the tube from site-to-site;

first actuator means on said carriage for erecting said tube from a generally horizontal attitude to a vertical attitude to prepare for drilling into the ground;

a second carriage, said second carriage being mounted on said tube and linearly drivable along said tube;

a first gear rack connected to said second carriage;

a second gear rack secured to said tube inside said tube;

second actuator means inside said tube and having a first portion secured to said tube and a second portion linearly movable inside said tube longitudinally of said tube; and a pinion mounted to the movable portion of said second actuator means and engaging said first and second gear racks whereby said second carriage is driven longitudinally along said tube as said second actuator means drives said second portion thereof longitudinally inside said tube.

6. The combination of claim 5 and further comprising:

a drill drive motor on said first rack and having a drill drive axis parallel to the length of said tube.

7. The combination of claim 6 and further comprising:

a drill string coupled to said drive motor.

8. The combination of claim 5 wherein:

said first actuator means and said second actuator means each include a hydraulic actuator; and the combination further comprising:

hydraulic power supply means on said first carriage for supplying pressurized hydraulic fluid to said first and second actuator means.

9. The combination of claim 5 and wherein:

said second carriage is slide mounted inside said tube.

10. The combination of claim 9 and further comprising:

a drill drive motor mounted outside said tube and connected to said second carriage and thereby drivable along said tube as said second actuator means drives said second carriage.

11. The combination of claim 10 and wherein:

the second actuator means is provided with power sufficient that, when said tube is erected and a drill is connected to said motor and engaging the earth, said second power actuator means can lift said tube and a portion of said first carriage to apply bearing force on the drill.

12. The combination of claim 5 wherein:

said first carriage is a motor truck.

* * * * *